US012285118B2

(12) United States Patent
Wu et al.

(10) Patent No.: US 12,285,118 B2
(45) Date of Patent: Apr. 29, 2025

(54) PLAYPEN COMPONENT FOR SAFE USE

(71) Applicant: Xiamen Xingshuo Maternal & Child Products Co., Ltd, Xiamen (CN)

(72) Inventors: Zuoxing Wu, Xiamen (CN); Hualing Zeng, Xiamen (CN); Huafeng Zeng, Xiamen (CN)

(73) Assignee: Xiamen Xingshuo Maternal & Child Products Co., Ltd, Xiamen (CN)

( * ) Notice: Subject to any disclaimer, the term of this patent is extended or adjusted under 35 U.S.C. 154(b) by 398 days.

(21) Appl. No.: 18/080,780

(22) Filed: Dec. 14, 2022

(65) Prior Publication Data

US 2023/0320498 A1 Oct. 12, 2023

(30) Foreign Application Priority Data

Apr. 8, 2022 (CN) ..... 202220803728.8
Sep. 19, 2022 (CN) ..... 202222474612.7

(51) Int. Cl.
*A47D 13/06* (2006.01)

(52) U.S. Cl.
CPC ..... *A47D 13/061* (2013.01)

(58) Field of Classification Search
CPC ..... A47D 13/00; A47D 13/06; A47D 13/061; A47D 13/063; A47D 13/065; A47D 13/066; A47D 11/007; A47D 9/00; A47D 9/005; A47D 9/012
See application file for complete search history.

(56) References Cited

U.S. PATENT DOCUMENTS

| | | | | |
|---|---|---|---|---|
| 5,881,789 | A * | 3/1999 | Melashenko | A47G 5/00 403/217 |
| 6,190,082 | B1 * | 2/2001 | Butterfield | E04H 4/06 403/325 |
| 10,932,589 | B1 * | 3/2021 | Flannery | A01K 1/035 |
| 10,954,980 | B2 * | 3/2021 | Turowski | F16B 12/2027 |
| 2009/0260184 | A1 * | 10/2009 | Yu | A47D 13/063 16/232 |
| 2014/0075670 | A1 * | 3/2014 | Crumrine | A47D 13/061 256/25 |
| 2016/0183698 | A1 * | 6/2016 | Szymanski | A47D 13/066 5/99.1 |
| 2018/0110344 | A1 * | 4/2018 | Matsumoto | A47D 15/00 |
| 2020/0077807 | A1 * | 3/2020 | Taylor | A47D 13/063 |
| 2023/0284795 | A1 * | 9/2023 | Lin | A47D 13/061 |

* cited by examiner

*Primary Examiner* — George Sun
(74) *Attorney, Agent, or Firm* — Bayramoglu Law Offices LLC

(57) ABSTRACT

A playpen component for safe use includes a left connector and a right connector. The right end of the left connector is provided with an upper connecting cylinder, the left end of the right connector is provided with a lower connecting cylinder, and the upper connecting cylinder and the lower connecting cylinder are socketed together. A tube insert and an elastic limit button are arranged in the right connector. An elastic clamping member is arranged in the tube insert. The left end of the clamping member extends out of the tube insert and the right connector, and the left end surface of the clamping member is adapted to the outer peripheral surface of the upper connecting cylinder. The outer periphery of the right connector is provided with a sliding member that drives the clamping member to move. The limit button is located above the tube insert.

9 Claims, 6 Drawing Sheets

PLAYPEN COMPONENT FOR SAFE USE

CROSS REFERENCE TO THE RELATED APPLICATION

This application is based upon and claims priority to Chinese Patent Application No. 202220803728.8, filed on Apr. 8, 2022, and Chinese Patent Application No. 202222474612.7, filed on Sep. 19, 2022, the entire contents of which are incorporated herein by reference.

TECHNICAL FIELD

The present disclosure relates to the field of baby products, particularly a playpen component for safe use.

BACKGROUND

At present, the playpens on the market are mainly made of plastic and wood materials and aim to free the mother's hands by providing a safe and comfortable environment for the baby. The playpen is conducive to the cultivation of the baby's independent consciousness, thinking ability, and concentration, and provides a good play place for the baby to develop physical coordination. In the prior art, the playpen is composed of a plurality of fence pieces spliced together. The adjacent fence pieces are connected by a splicing component, including a left connector and a right connector. The right end of the left connector is provided with an upper connecting cylinder, and the left end of the right connector is provided with a lower connecting cylinder, such that the upper connecting cylinder and the lower connecting cylinder are socketed together. However, the socketed upper and lower connecting cylinders are not fixed, which may lead to the separation of the left connector and the right connector when the left connector is lifted accidentally. Given the above defect, the inventor has performed research on this problem and, as a result, provides the following solution to the problem.

SUMMARY

The present disclosure provides a playpen component for safe use and aims to avoid the separation of a left connector and a right connector of the existing fence splicing component in use.

To solve the above technical problems, the present disclosure adopts the following technical solution:

A playpen component for safe use includes a left connector and a right connector. The right end of the left connector is provided with an upper connecting cylinder, and the left end of the right connector is provided with a lower connecting cylinder, such that the upper connecting cylinder and the lower connecting cylinder are socketed together. A tube insert and an elastic limit button are arranged in the right connector. An elastic clamping member is arranged in the tube insert. The left end of the clamping member extends out of the tube insert and the right connector, and the left end surface of the clamping member is adapted to the outer peripheral surface of the upper connecting cylinder. The outer periphery of the right connector is provided with a sliding member that drives the clamping member to move. The limit button is located above the tube insert. The top of the limit button extends out of the top surface of the right connector. The sliding member abuts the limit button when the limit button is not pressed.

Further, the clamping member is in a right-angle shape, and a first movable groove in a right-angle shape is arranged in the tube insert. The clamping member is adapted to the first movable groove and is located in the first movable groove. A first spring abutting the right end of the clamping member is arranged in the transverse part of the first movable groove, and a second spring is arranged between the top of the tube insert and the bottom of the limit button.

Further, the transverse part of the clamping member is provided with a first strip-type groove that runs through from the front and the back of the clamping member. The front side surface and the back side surface of the tube insert are provided with a second strip-type groove communicated with the first movable groove. The front side surface and the back side surface of the right connector are provided with a third strip-type groove. The sliding member is in an n-shape in the lateral direction. The front side surface and the back side surface of the right connector are provided with a sliding groove. The two ends of the bottom of the sliding member are provided with a sliding part, and the sliding part corresponds to the sliding groove and is located in the sliding groove. The sliding member is connected to the right connector through a first pin shaft, and the first pin shaft runs through the sliding member, the third strip-type groove, the second strip-type groove, and the first strip-type groove. The top of the limit button is provided with a clamping step, and the top right side surface of the sliding member is capable of abutting the side surface of the clamping step.

Further, an engagement gear is arranged in the upper connecting cylinder and the lower connecting cylinder. The lower part of the inner perimeter of the upper connecting cylinder and the upper part of the inner perimeter of the lower connecting cylinder are respectively provided with an upper tooth groove and a lower tooth groove that are engaged with the engagement gear. The bottom of the engagement gear is provided with a pressing column that drives the engagement gear to move up, and the bottom of the pressing column extends out of the bottom of the lower connecting cylinder. A knob capable of adopting to the engagement gear and a first torsion spring connected to the knob are both arranged in the top of the upper connecting cylinder. The knob and the engagement gear can be separately arranged when the knob rotates. A first step capable of abutting the bottom of the engagement gear is arranged in the upper part of the lower connecting cylinder.

Further, the bottom of the engagement gear is provided with a connecting column. The pressing column is connected to the connecting column, and the connecting column is located in the lower connecting cylinder. A guide shaft is arranged in the lower part of the upper connecting cylinder. The middle part of the engagement gear is provided with a guide groove adapted to the guide shaft, and the guide shaft extends into the guide groove.

Further, the bottom of the knob is symmetrically provided with two extension strips. The lower side surfaces of the two extension strips are provided with first inclined planes, and the bottoms of the two extension strips are provided with hook parts. Two through grooves are symmetrically arranged in the upper part of the upper connecting cylinder, and each of the through grooves corresponds to each of the extension strips. The inner wall of the guide groove is symmetrically provided with two placement grooves, and each of the placement grooves corresponds to each of the extension strips. The width of each of the through grooves and the width of each of the placement grooves is larger than the width of each of the extension strips. The top of the side walls of the two placement grooves is provided with clamp parts. The top surfaces of the clamp parts are provided with second inclined planes fitting with the first inclined planes. The hook parts can hook the bottom surfaces of the clamp parts.

Further, the left end of the left connector is provided with a left tube connector that can be raised and lowered, and the right end of the right connector is provided with a right tube connector that can be raised and lowered.

Further, an unlock lever and an unlock button are arranged in each of the left tube connector and the right tube connector and hinged with each of the left tube connector and the right tube connector. The bottom of the unlock lever abuts the unlock button when the unlock lever is not triggered. The top of the unlock lever correspondingly extends out of the tops of the left tube connector and the right tube connector, and the bottom of the unlock button correspondingly extends out of the bottoms of the left tube connector and the right tube connector. A locking latch is arranged in the unlock button and capable of moving along with the unlock button.

Further, a second torsion spring is correspondingly connected to the left tube connector and the right tube connector and arranged in the unlock lever. The unlock button is provided with a second step. The bottom of the unlock lever abuts the second step when the unlock lever is not triggered. The unlock button is provided with a second movable groove and two fourth strip-type grooves. The locking latch is located in the second movable groove. The two fourth strip-type grooves are located on two sides of the locking latch, and a second pin shaft penetrates through the locking latch and is arranged between the two fourth strip-type grooves.

From the above description of the present disclosure, compared with the prior art, the present disclosure has the following advantages: The structure and design of the present disclosure are novel and ingenious. The upper connecting cylinder and the lower connecting cylinder are socketed together when in use, and the clamping member can tightly clamp the outer periphery of the connecting cylinders. Even if the left connector is lifted, the left connector and the right connector will not be separated. When the left connector and the right connector must be separated, the limit button is pressed, and the clamping member is driven to move by the sliding member so that the left end surface of the clamping member is separated from the outer peripheral surface of the upper connecting cylinder. At this time, the user lifts the left connector to separate the left connector from the right connector. The present disclosure can effectively avoid the separation of the left connector and the right connector when in use, and the use of the playpen is safer.

DETAILED DESCRIPTION OF THE EMBODIMENTS

Figure 1:
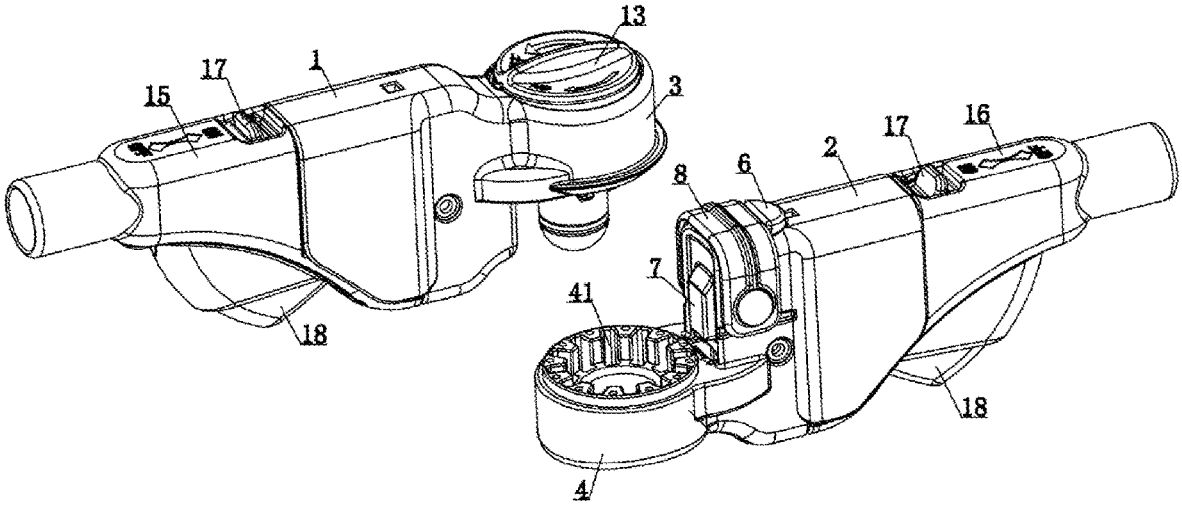
FIG. 1 is a schematic diagram showing a structure of the present disclosure.
Figure 2:
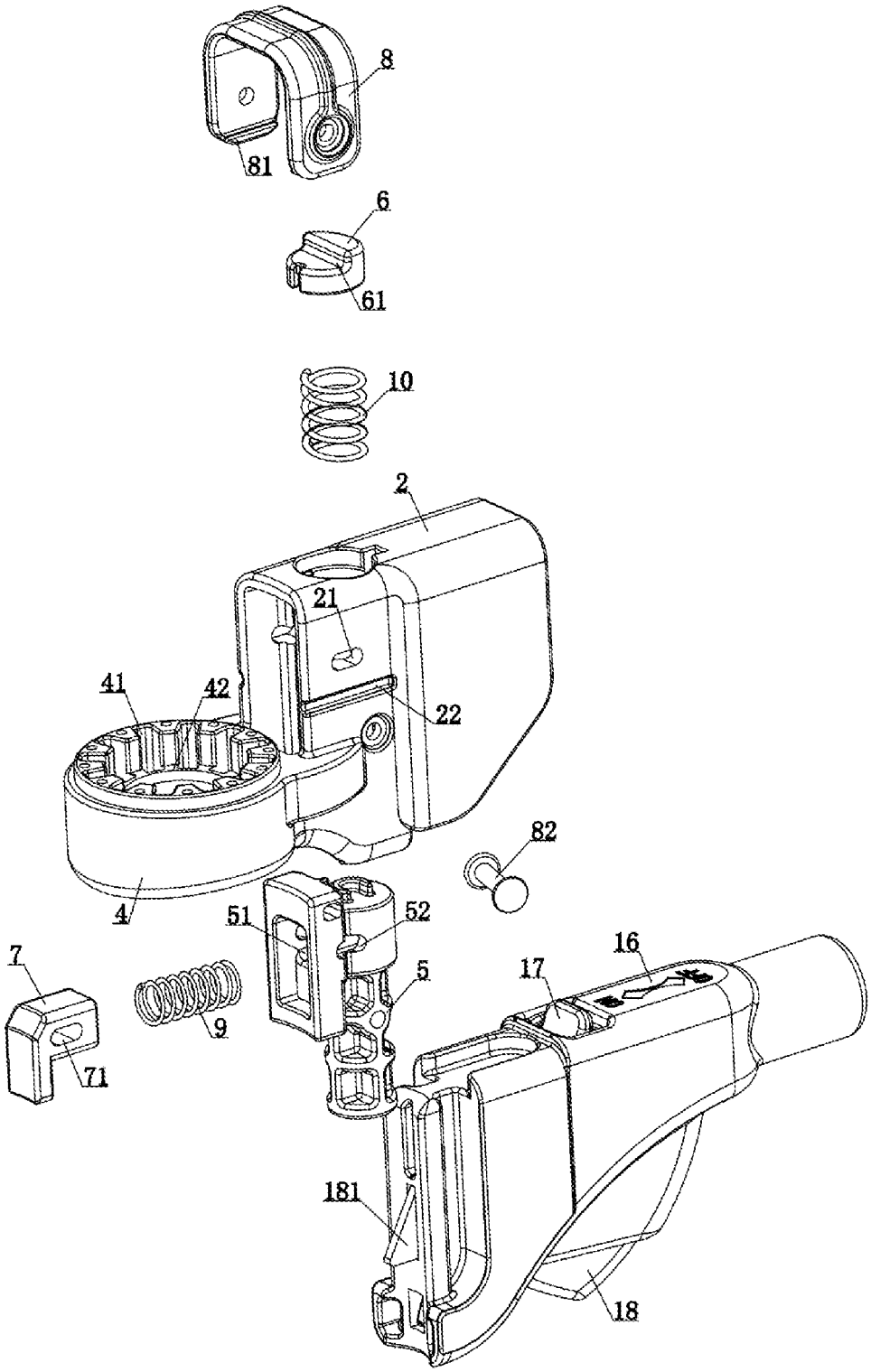
FIG. 2 is a schematic diagram showing an exploded structure of a right connector and an exploded structure of a right tube connector of the present disclosure.

Referring to FIG. 1 and FIG. 2, a playpen component for safe use includes the left connector 1 and the right connector 2. The right end of the left connector 1 is provided with the upper connecting cylinder 3, the left end of the right connector 2 is provided with the lower connecting cylinder 4, and the upper connecting cylinder 3 and the lower connecting cylinder 4 are socketed. The tube insert 5 and the elastic limit button 6 are arranged in the right connector 2. The elastic clamping member 7 is arranged in the tube insert 5. The left end of the clamping member 7 extends out of the tube insert 5 and the right connector 2, and the left end surface of the clamping member 7 is adapted to the outer peripheral surface of the upper connecting cylinder 3. The outer periphery of the right connector 2 is provided with the sliding member 8 that drives the clamping member 7 to move. The limit button 6 is located above the tube insert 5, the top of the limit button 6 extends out of the top surface of the right connector 2, and the sliding member 8 abuts the limit button 6 when the limit button 6 is not pressed.

Referring to FIGS. 1-2, the clamping member 7 is in a right-angle shape, and the first movable groove 51 in a right-angle shape is arranged in the tube insert 5. The clamping member 7 is adapted to the first movable groove 51 and is located in the first movable groove 51. The first spring 9 abutting the right end of the clamping member 7 is arranged in the transverse part of the first movable groove 51, and the second spring 10 is arranged between the top of the tube insert 5 and the bottom of the limit button 6. The transverse part of the clamping member 7 is provided with the first strip-type groove 71 that runs through from the front and the back of the clamping member 7. The front side surface and the back side surface of the tube insert 5 are provided with the second strip-type groove 52 communicating with the first movable groove 51. The front side surface and the back side surface of the right connector 2 are provided with the third strip-type groove 21. The sliding member 8 is in an n-shape in the lateral direction. The front side surface and the back side surface of the right connector 2 are provided with the sliding groove 22. Two ends of the bottom of the sliding member 8 are provided with the sliding part 81. The sliding part 81 corresponds to the sliding groove 22 and is located in the sliding groove 22. The sliding member 8 is connected to the right connector 2 through the first pin shaft 82. The first pin shaft 82 runs through the sliding member 8, the third strip-type groove 21, the second strip-type groove 52, and the first strip-type groove 71. The top of the limit button 6 is provided with the clamping step 61. The top right side surface of the sliding member 8 abuts the side surface of the clamping step 61 when the limit button 6 is not pressed.

Referring to FIGS. 1-4, the engagement gear 11 is arranged in the upper connecting cylinder 3 and the lower connecting cylinder 4. The lower part of the inner perimeter of the upper connecting cylinder 3 and the upper part of the inner perimeter of the lower connecting cylinder 4 are respectively provided with the upper tooth groove 31 and the lower tooth groove 41 that are engaged with the engagement gear 11. The bottom of the engagement gear 11 is provided with the pressing column 12 that drives the engagement gear 11 to move up. The bottom of the pressing column 12 extends out of the bottom of the lower connecting cylinder 4. The knob 13 capable of adopting to the engagement gear 11 and the first torsion spring 14 connected with the knob 13 are both arranged in the top of the upper connecting cylinder 3. The knob 13 and the engagement gear 11 can be separately arranged when the knob 13 rotates. The first step 42 capable of abutting the bottom of the engagement gear 11 is arranged in the upper part of the lower connecting cylinder 4. The bottom of the engagement gear 11 is provided with the connecting column 111. The pressing column 12 is connected to the connecting column 111, and the connecting column 111 is located in the lower connecting cylinder 4. The guide shaft 32 is arranged in the lower part of the upper connecting cylinder 3. The middle part of the engagement gear 11 is provided with the guide groove 112 adapted to the guide shaft 32, and the guide shaft 32 extends into the guide groove 112. The first reset spring 116 is arranged in the guide groove 112, and the guide shaft 32 extends into the first reset spring 116.

Figure 3:
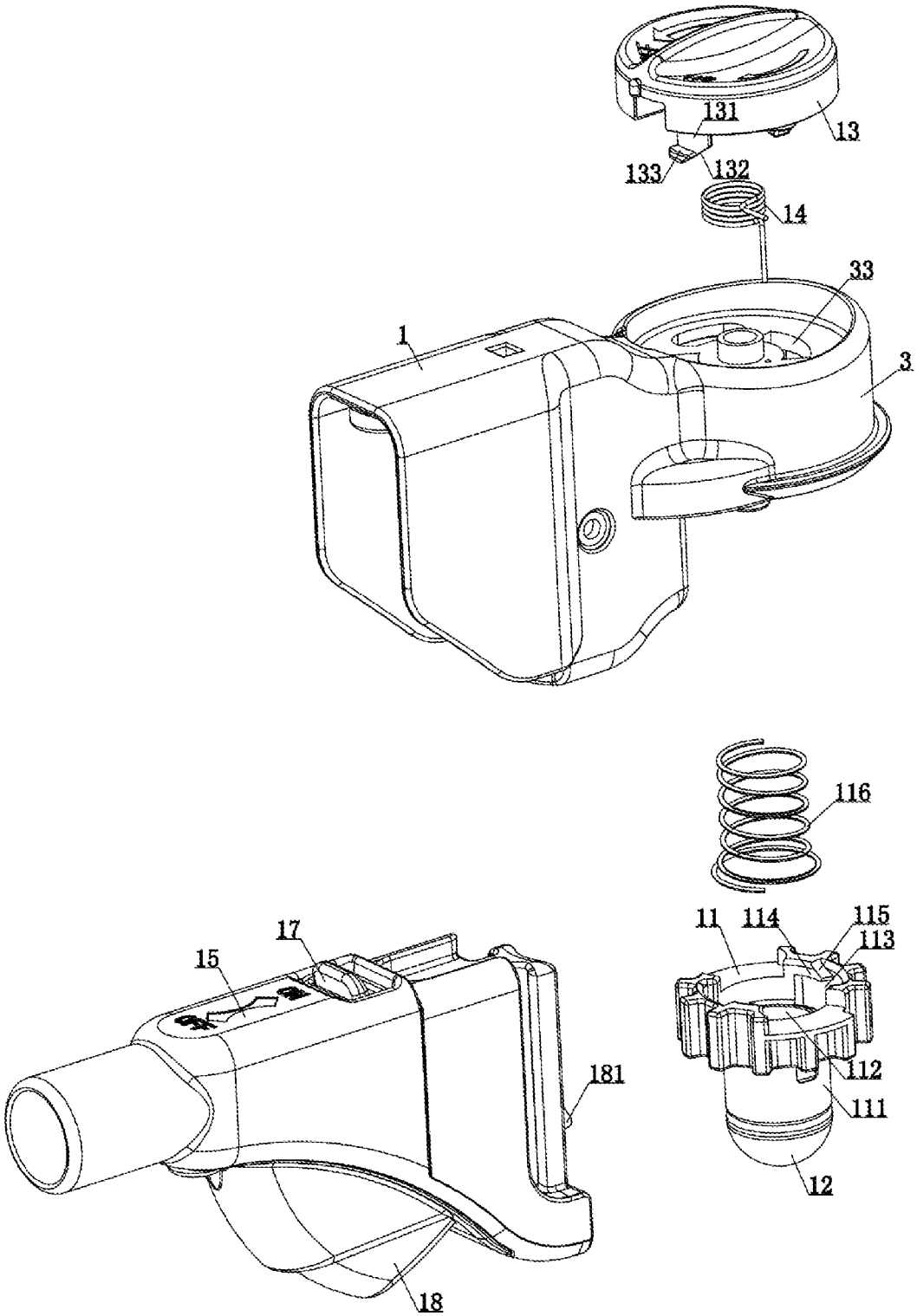
FIG. 3 is a schematic diagram showing an exploded structure of a left connector and an exploded structure of a left tube connector of the present disclosure.
Figure 4:
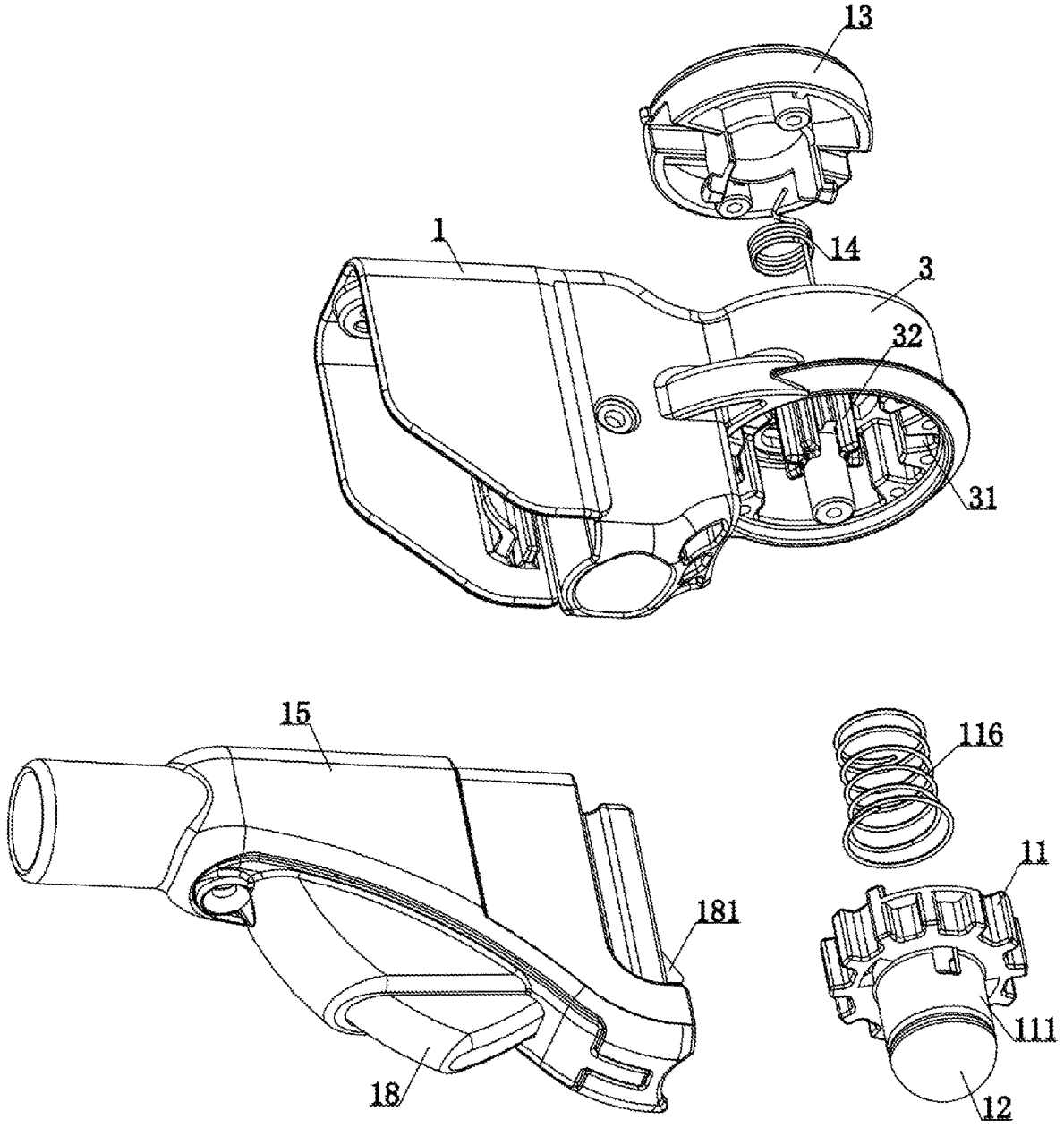
FIG. 4 is a schematic diagram of FIG. 3 from a different angle.
Figure 5:
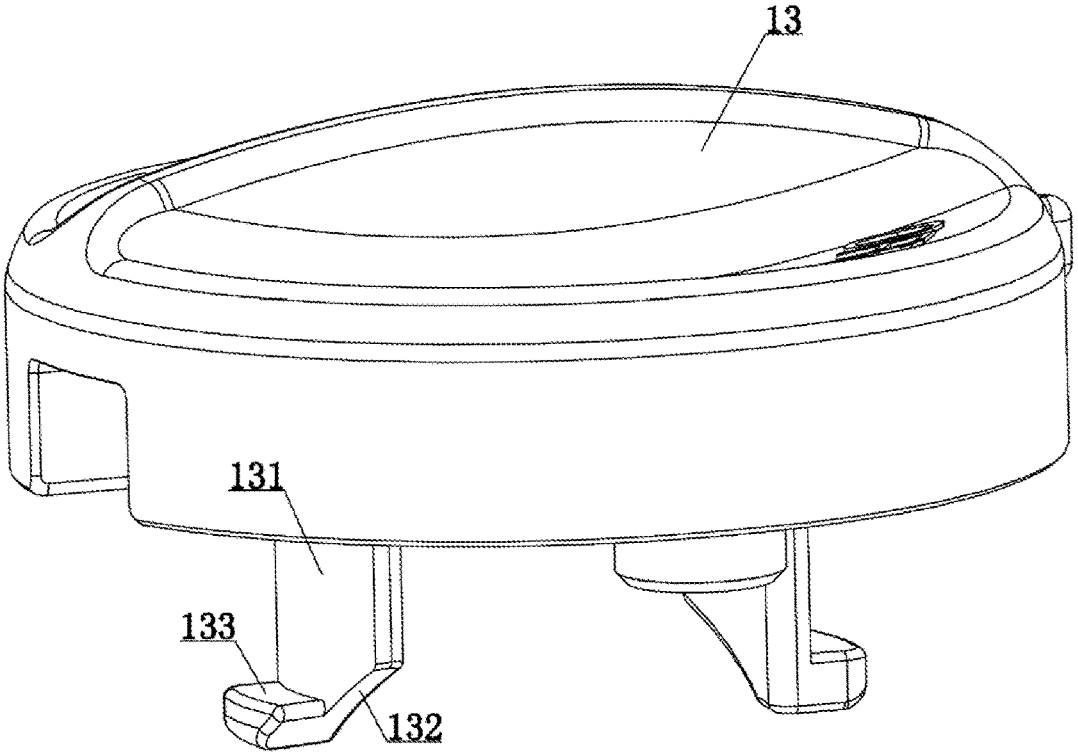
FIG. 5 is a schematic diagram showing a structure of a knob of the present disclosure.
Figure 6:
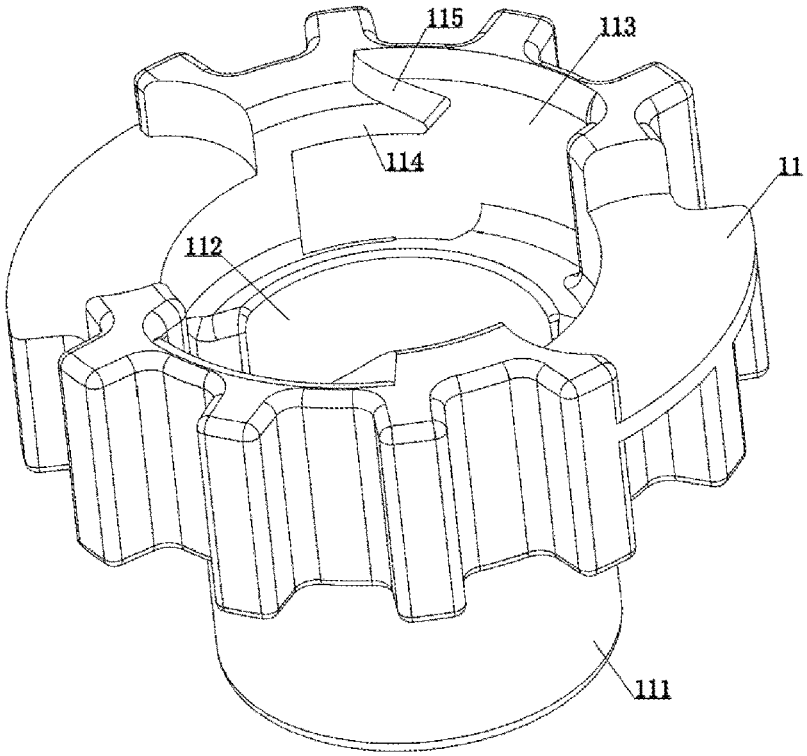
FIG. 6 is a schematic diagram showing a structure of an engagement gear of the present disclosure.

Referring to FIGS. 3, 5, and 6, the bottom of the knob 13 is symmetrically provided with the two extension strips 131. The lower side surfaces of the two extension strips 131 are provided with the first inclined planes 132, and the bottoms of the two extension strips 131 are provided with the hook parts 133. The two through grooves 33 are symmetrically arranged in the upper part of the upper connecting cylinder 3, and each of the through grooves 33 corresponds to one of the extension strips 131. The inner wall of the guide groove 112 is symmetrically provided with the two placement grooves 113, and each of the placement grooves 113 corresponds to one of the extension strips 131. The width of each of the through grooves 33 and the width of each of the placement grooves 113 is larger than the width of each of the extension strips 131. The tops of the side walls of the two placement grooves 113 are provided with the clamp parts 114. The top surfaces of the clamp parts 114 are provided with the second inclined planes 115 fitting with the first inclined planes 132, and the hook parts 133 can hook the bottom surfaces of the clamp parts 114.

Referring to FIGS. 1-6, when in use, the upper connecting cylinder 3 and the lower connecting cylinder 4 are socketed. The clamping member 7 can clamp the outer periphery of the upper connecting cylinder 3. Even if the left connector 1 is lifted, the left connector 1 and the right connector 2 will not be separated. When the left connector 1 and the right connector 2 need to be separated, the lower limit button 6 is pressed, and the top right side surface of the sliding member 8 does not abut the side surface of the clamping step 61. Then the sliding member 8 drives the clamping member 7 to move to the right so that the left end surface of the clamping member 7 is separated from the outer peripheral surface of the upper connecting cylinder 3. At this time, the left connector 1 can be separated from the right connector 2 by lifting the left connector 1. When the angle between the left connector 1 and the right connector 2 must be changed, the pressing column 12 is pressed to raise the engagement gear 11, and the risen engagement gear 11 separates from the lower tooth groove 41. When the engagement gear 11 is in contact with the extension strips 131 of the knob 13, the knob 13 rotates automatically clockwise under the cooperation of the first inclined planes 132 and the second inclined planes 115. After the first inclined planes 132 and the second inclined planes 115 are separated, the knob 13 is reset under the action of the first torsion spring 14 so that the hook parts 133 hooks the corresponding clamp parts 114. In this way, the upper connecting cylinder 3 and the lower connecting cylinder 4 can be rotated to adjust their angle, that is, the left connector 1 and the right connector 2 can be rotated to adjust their angle. When the upper connecting cylinder 3 and the lower connecting cylinder 4 are adjusted to the required angle, the knob 13 is rotated counterclockwise so that the hook parts 133 is detached from the corresponding clamp parts 114. The engagement gear 11 is separated from the knob 13, the engagement gear 11 is lowered and engaged again with both the upper tooth groove 31 and the lower tooth groove 41, thereby fixing the upper connecting cylinder 3 and the lower connecting cylinder 4.

Referring to FIGS. 1-3, the left end of the left connector 1 is provided with the left tube connector 15 and can be raised and lowered, and the right end of the right connector 2 is provided with the right tube connector 16 and can be raised and lowered. The unlock lever 17 and the unlock button 18 are arranged in and hinged with each of the left tube connector 1 and the right tube connector 2. The bottom of the unlock lever 17 abuts the unlock button 18 when the unlock lever 17 is not triggered. The top of the unlock lever 17 correspondingly extends out of the tops of the left tube connector 15 and the right tube connector 16. The bottom of the unlock button 18 correspondingly extends out of the bottoms of the left tube connector 15 and the right tube connector 16. The locking latch 181 capable of moving along with the unlock button 18 is arranged in the unlock button 18.

Referring to FIGS. 1-3 and FIG. 7, the second torsion spring 19 is correspondingly connected to the left tube connector 15 and the right tube connector 16 and arranged in the unlock lever 17. The unlock button 18 is provided with the second step 182. The bottom of the unlock lever 17 abuts the second step 182 when the unlock lever 17 is not triggered. The unlock button 18 is provided with the second movable groove 183 and the two fourth strip-type grooves 184. The locking latch 181 is located in the second movable groove 183. The two fourth strip-type grooves 184 are located on both sides of the locking latch 181. The second pin shaft 20 penetrating through the locking latch 181 is arranged between the two fourth strip-type grooves 184. The second reset spring 185 is arranged at one end of the locking latch 181.

Figure 7:
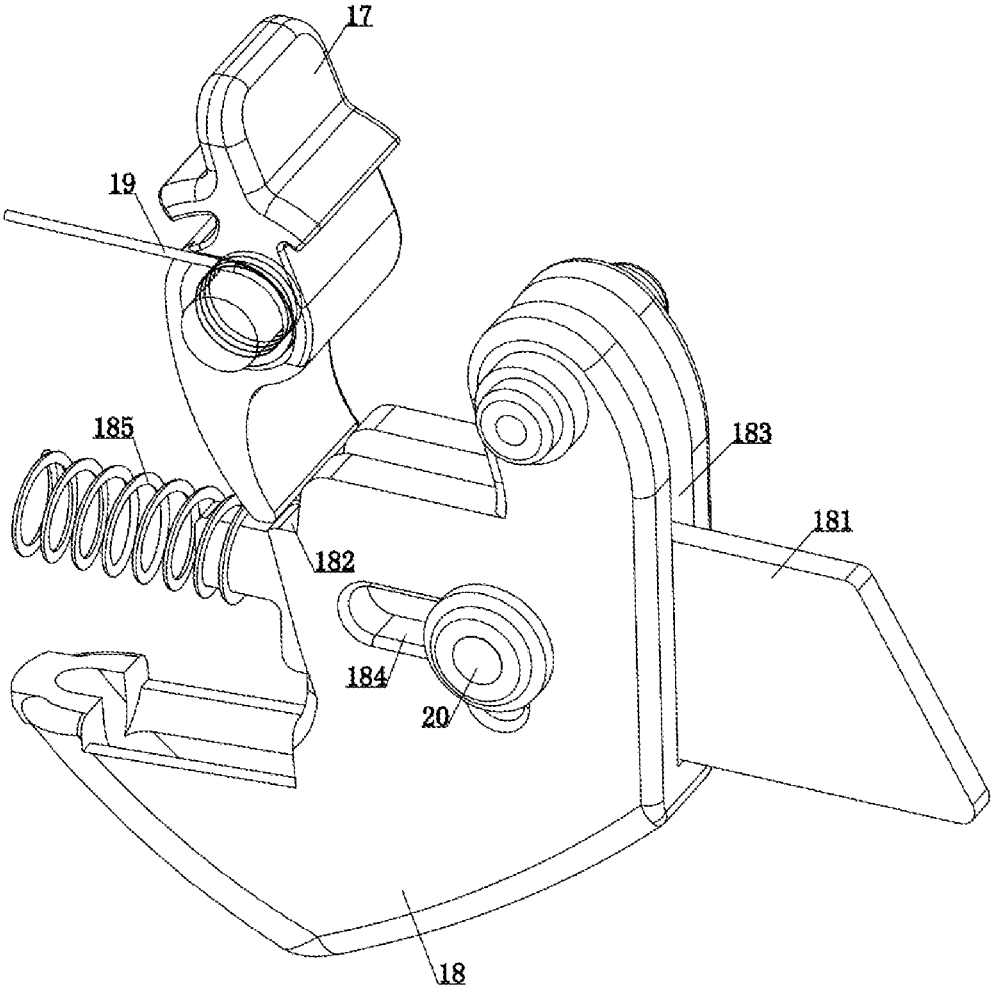
FIG. 7 is a schematic diagram showing a matching structure of an unlock lever and an unlock button of the present disclosure.
Figure 8:
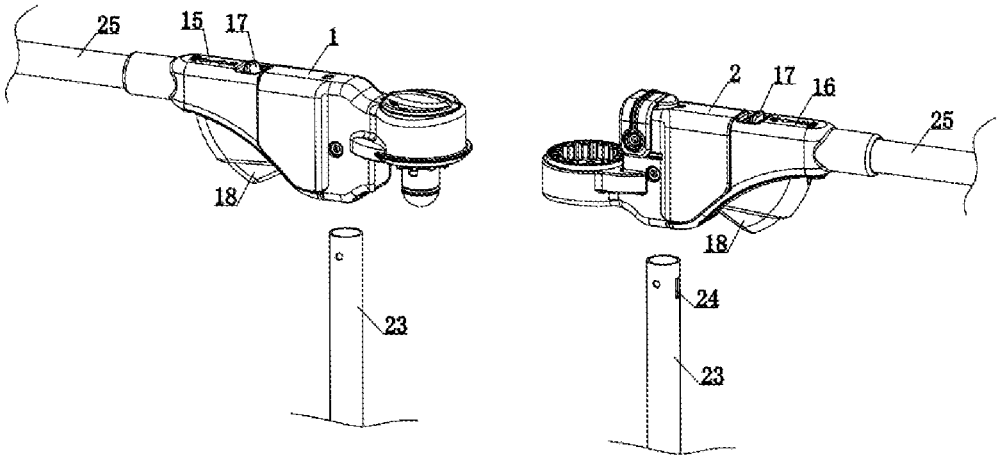
FIG. 8 is a schematic diagram showing a structure of a vertical tube and a structure of a horizontal tube of the present disclosure.

Referring to FIGS. 7-8, the vertical tube 23 is arranged in each of the bottoms of the left connector 1 and the right connector 2. The top side surface of the vertical tube 23 is provided with the locking latch groove 24. The left tube connector 15 and the right tube connector 16 are connected to the horizontal tube 25. The left tube connector 15 and the right tube connector 16 can be raised and lowered. The unlock lever 17 is first triggered to separate the bottom of the unlock lever 17 from the second step 182 of the unlock button 18 when the left tube connector 15 and the right tube connector 16 need to be raised and lowered. At this time, the unlock button 18 can be pressed. After the unlock button 18 is pressed, the locking latch 181 moves and is separated from the locking latch groove 24. The left tube connector 15 and the right tube connector 16 can be lowered relative to the left connector 1 and the right connector 2, respectively.

The above are only specific embodiments of the present disclosure, but the idea of the present disclosure is not limited to this, and any non-substantive modification of the present disclosure by using this idea shall fall within the act of infringing upon the scope of protection of the present disclosure.

What is claimed is:

1. A playpen component for safe use, comprising a left connector and a right connector;

wherein a right end of the left connector is provided with an upper connecting cylinder, a left end of the right connector is provided with a lower connecting cylinder, and the upper connecting cylinder and the lower connecting cylinder are socketed together;

wherein a tube insert and an elastic limit button are arranged in the right connector; an elastic clamping member is arranged in the tube insert; a left end of the elastic clamping member extends out of the tube insert and the right connector, and a left end surface of the elastic clamping member is adapted to an outer peripheral surface of the upper connecting cylinder; an outer periphery of the right connector is provided with a sliding member configured to drive the elastic clamping member to move; the elastic limit button is located above the tube insert, a top of the elastic limit button extends out of a top surface of the right connector, and the sliding member abuts the elastic limit button when the elastic limit button is not pressed.

2. The playpen component for safe use according to claim 1, wherein the elastic clamping member is in a right-angle shape, and a first movable groove in a right-angle shape is arranged in the tube insert; the elastic clamping member is adapted to the first movable groove and is located in the first movable groove; a first spring abutting a right end of the elastic clamping member is arranged in a transverse part of the first movable groove, and a second spring is arranged between a top of the tube insert and a bottom of the elastic limit button.

3. The playpen component for safe use according to claim 2, wherein a transverse part of the elastic clamping member is provided with a first strip-type groove runs through a front and a back of the elastic clamping member, and a front side surface and a back side surface of the tube insert are provided with a second strip-type groove communicated with the first movable groove; a front side surface and a back side surface of the right connector are provided with a third strip-type groove; the sliding member is in an n-shape in a lateral direction; a front side surface and a back side surface of the right connector are provided with a sliding groove, two ends of a bottom of the sliding member are provided with a sliding part, and the sliding part corresponds to the sliding groove and is located in the sliding groove; the sliding member is connected to the right connector through a first pin shaft, and the first pin shaft runs through the sliding member, the third strip-type groove, the second strip-type groove, and the first strip-type groove; a top of the elastic limit button is provided with a clamping step, and a top right side surface of the sliding member is capable of abutting a side surface of the clamping step.

4. The playpen component for safe use according to claim 1, wherein an engagement gear is arranged in the upper connecting cylinder and the lower connecting cylinder, and a lower part of an inner perimeter of the upper connecting cylinder and an upper part of an inner perimeter of the lower connecting cylinder are respectively provided with an upper tooth groove and a lower tooth groove that are engaged with the engagement gear; a bottom of the engagement gear is provided with a pressing column configured to drive the engagement gear to move up, and a bottom of the pressing column extends out of a bottom of the lower connecting cylinder; a knob capable of adopting to the engagement gear and a first torsion spring connected with the knob are arranged in a top of the upper connecting cylinder; the knob and the engagement gear are separately arranged when the knob rotates; a first step configured to abut the bottom of the engagement gear is arranged in an upper part of the lower connecting cylinder.

5. The playpen component for safe use according to claim 4, wherein the bottom of the engagement gear is provided with a connecting column, the pressing column is connected to the connecting column, and the connecting column is located in the lower connecting cylinder; a guide shaft is arranged in a lower part of the upper connecting cylinder, a middle part of the engagement gear is provided with a guide groove adapted to the guide shaft, and the guide shaft extends into the guide groove.

6. The playpen component for safe use according to claim 5, wherein a bottom of the knob is symmetrically provided with two extension strips, lower side surfaces of the two extension strips are provided with first inclined planes, and bottoms of the two extension strips are provided with hook parts; two through grooves are symmetrically arranged in an upper part of the upper connecting cylinder, each of the two through grooves corresponds to each of the two extension strips; an inner wall of the guide groove is symmetrically provided with two placement grooves, and each of the two placement grooves corresponds to each of the two extension strips; a width of each of the two through grooves and a width of each of the two placement grooves is larger than a width of each of the two extension strips, and a top of side walls of the two placement grooves is provided with clamp parts; top surfaces of the clamp parts are provided with second inclined planes fitting with the first inclined planes, and the hook parts are configured to hook bottom surfaces of the clamp parts.

7. The playpen component for safe use according to claim 4, wherein a left end of the left connector is provided with a left tube connector, wherein the left tube connector is allowed to be raised and lowered, and a right end of the right connector is provided with a right tube connector, wherein the left tube connector is allowed to be raised and lowered.

8. The playpen component for safe use according to claim 7, wherein an unlock lever and an unlock button are arranged in each of the left tube connector and the right tube connector and hinged with each of the left tube connector and the right tube connector; a bottom of the unlock lever abuts the unlock button when the unlock lever is not triggered; a top of the unlock lever correspondingly extends out of tops of the left tube connector and the right tube connector, and a bottom of the unlock button correspondingly extends out of bottoms of the left tube connector and the right tube connector; a locking latch configured to move along with the unlock button is arranged in the unlock button, an end of the locking latch correspondingly extends out of the left tube connector and the right tube connector.

9. The playpen component for safe use according to claim 8, wherein a second torsion spring is correspondingly connected to the left tube connector and the right tube connector and arranged in the unlock lever, and the unlock button is provided with a second step; the bottom of the unlock lever abuts the second step when the unlock lever is not triggered; the unlock button is provided with a second movable groove and two fourth strip-type grooves, and the locking latch is located in the second movable groove; the two fourth strip-type grooves are located on two sides of the locking latch, and a second pin shaft penetrating through the locking latch is arranged between the two fourth strip-type grooves.

* * * * *